US009480613B1

(12) United States Patent
Lackey

(10) Patent No.: US 9,480,613 B1
(45) Date of Patent: Nov. 1, 2016

(54) PATIENT SUPPORT SYSTEM

(71) Applicant: Sheila Lackey, Sarasota, FL (US)

(72) Inventor: Sheila Lackey, Sarasota, FL (US)

( * ) Notice: Subject to any disclaimer, the term of this patent is extended or adjusted under 35 U.S.C. 154(b) by 0 days.

(21) Appl. No.: 14/558,824

(22) Filed: Dec. 3, 2014

(51) Int. Cl.
*A61G 7/10* (2006.01)
*A61G 1/01* (2006.01)

(52) U.S. Cl.
CPC ..... *A61G 7/1023* (2013.01); *A61G 1/01* (2013.01); *A61G 7/10* (2013.01); *A61G 7/1026* (2013.01); *A61G 7/1051* (2013.01); *A61G 7/1055* (2013.01); *A61G 7/1057* (2013.01)

(58) Field of Classification Search
CPC ..... A61G 7/1051; A61G 7/1057; A61G 7/1055; A61G 7/1026; A61G 7/103; A61G 7/10; A61G 7/1025; A61G 7/1036; A61G 7/1013; A61G 7/1023; A61G 1/01
See application file for complete search history.

(56) References Cited

U.S. PATENT DOCUMENTS 2,788,530 A * 4/1957 Ferguson ..... A61G 1/01 5/122
2,813,745 A * 11/1957 Frieder ..... B66C 1/127 294/77
3,006,179 A * 10/1961 Erickson ..... E05B 63/0017 292/140
3,750,202 A * 8/1973 Merikallio ..... A47G 9/086 5/413 R
4,675,925 A * 6/1987 Littleton ..... A61G 7/1026 5/484
4,686,719 A * 8/1987 Johnson ..... A61G 7/1021 180/125
4,723,327 A * 2/1988 Smith ..... A61G 7/1026 294/140
4,744,115 A * 5/1988 Marchione ..... A61G 7/1026 5/81.1 T
4,944,057 A * 7/1990 Shaw ..... A61G 7/1023 224/159

(Continued)

*Primary Examiner* — David E Sosnowski
*Assistant Examiner* — Morgan McClure

(57) ABSTRACT

A rectangular first sheet has a right side, a wrong side, and side edges. A pair of vertical straps are fabricated of an essentially inextensible strapping cord. Selective stitching couples each vertical strap to the wrong side of the first sheet with each vertical strap extending beyond the first sheet and parallel with and spaced a distance from an adjacent side edge. A pair of horizontal straps are fabricated of an essentially inextensible strapping cord. Additional selective stitching couples each horizontal strap to the wrong side of the first sheet with each end of each horizontal strap extending beyond the first sheet. A loop is formed at each end of each strap to create handles. A second sheet is in a rectangular configuration. Peripheral stitching couples the first sheet and the second sheet with the straps between the sheets.

1 Claim, 2 Drawing Sheets

(56) References Cited

U.S. PATENT DOCUMENTS 4,986,576 A * 1/1991 Anderson ..... E05B 35/08 292/40
5,050,254 A * 9/1991 Murphy ..... A61G 1/01 5/413 R
5,056,533 A * 10/1991 Solano ..... A47D 15/006 128/876
5,121,514 A * 6/1992 Rosane ..... A61G 1/01 128/870
5,978,989 A * 11/1999 Chavez ..... A61G 1/01 294/140
6,276,006 B1 * 8/2001 Hoit ..... A61G 7/1023 5/81.1 R
6,581,998 B1 * 6/2003 Clemens ..... A61G 1/01 294/141
6,634,044 B1 * 10/2003 Wright ..... A61G 1/01 5/625
D506,710 S * 6/2005 Hurtado ..... D12/133
D589,848 S * 4/2009 Giduck ..... D12/128
7,818,836 B2 * 10/2010 Stinson ..... A61G 7/001 5/487
9,022,134 B2 * 5/2015 Calkin ..... B32B 23/02 169/49
2002/0166168 A1 * 11/2002 Weedling ..... A61G 7/103 5/81.1 R
2003/0070234 A1 * 4/2003 Smith ..... A61G 1/01 5/627
2004/0163176 A1 * 8/2004 Berge ..... A47C 31/08 5/626
2005/0028273 A1 * 2/2005 Weedling ..... A61G 7/103 5/81.1 R
2005/0034230 A1 * 2/2005 Weedling ..... A61G 7/103 5/81.1 R
2006/0061050 A1 * 3/2006 Wolf ..... A61G 1/01 280/18
2009/0038076 A1 * 2/2009 Giduck ..... A61G 1/01 5/627
2011/0119831 A1 * 5/2011 Rincon ..... A61G 1/01 5/627
2011/0265263 A1 * 11/2011 Bartholomew ..... A61G 1/01 5/627
2011/0271450 A1 * 11/2011 Johnson ..... A61G 1/01 5/626
2011/0277234 A1 * 11/2011 Jasani ..... A61G 7/1026 5/81.1 R
2013/0133509 A1 * 5/2013 Searle ..... F41H 1/02 89/36.05
2013/0227789 A1 * 9/2013 Olson ..... A61G 1/013 5/625
2013/0227791 A1 * 9/2013 Kostron ..... A61G 1/01 5/629

* cited by examiner

FIG 1
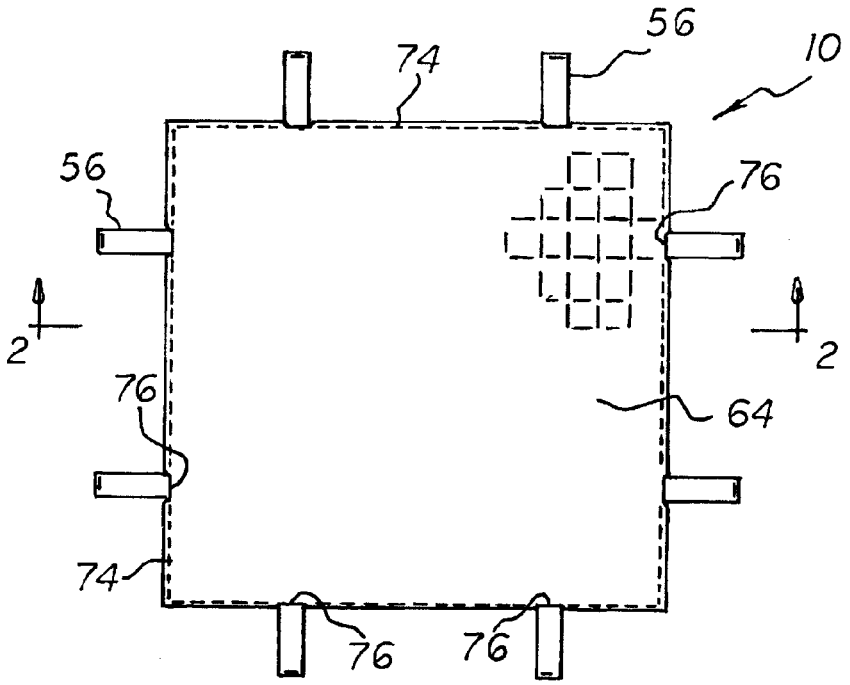
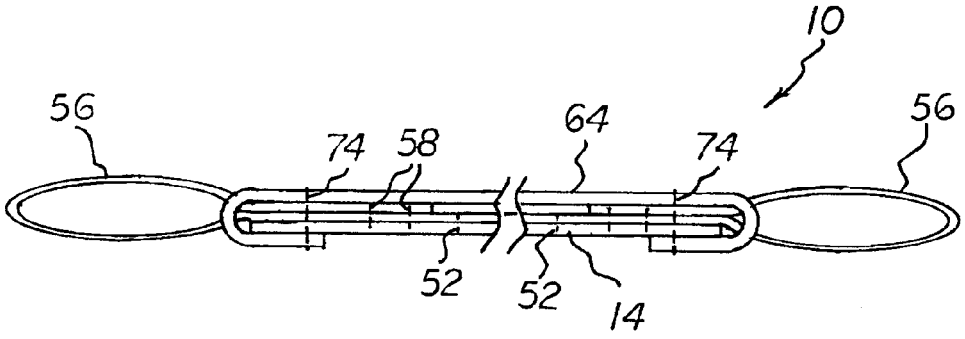
FIG 2

PATIENT SUPPORT SYSTEM

BACKGROUND OF THE INVENTION

1. Field of the Invention

The present invention relates to a patient support system and more particularly pertains to a system for lifting and holding a supine patient.

2. Description of the Prior Art

The use of patient assisting devices of known designs and configurations is known in the prior art. More specifically, patient assisting devices of known designs and configurations previously devised and utilized for the purpose of easing the burden on health care providers are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe patient support system that allows lifting and holding a supine patient.

In this respect, the patient support system according to the present invention substantially departs from the conventional concepts and designs of the prior art, and in doing so provides an apparatus primarily developed for the purpose of lifting and holding a supine patient.

Therefore, it can be appreciated that there exists a continuing need for a new and improved patient support system which can be used for lifting and holding a supine patient. In this regard, the present invention substantially fulfills this need.

SUMMARY OF THE INVENTION

In view of the foregoing disadvantages inherent in the known types of patient assisting devices of known designs and configurations now present in the prior art, the present invention provides an improved patient support system. As such, the general purpose of the present invention, which will be described subsequently in greater detail, is to provide a new and improved patient support system and method which has all the advantages of the prior art and none of the disadvantages.

To attain this, in a broad context, the present invention essentially comprises a rectangular first sheet having a right side, a wrong side, and side edges. A pair of vertical straps are fabricated of an essentially inextensible strapping cord. Selective stitching couples each vertical strap to the wrong side of the first sheet with each vertical strap extending beyond the first sheet and parallel with and spaced a distance from an adjacent side edge. A pair of horizontal straps are fabricated of an essentially inextensible strapping cord. Additional selective stitching couples each horizontal strap to the wrong side of the first sheet with each end of each horizontal strap extending beyond the first sheet. A loop is formed at each end of each strap to create handles. A second sheet is in a rectangular configuration. Peripheral stitching couples the first sheet and the second sheet with the straps between the sheets.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved patient support system which has all of the advantages of the prior art patient assisting devices of known designs and configurations and none of the disadvantages.

It is another object of the present invention to provide a new and improved patient support system which may be easily and efficiently manufactured and marketed.

It is a further object of the present invention to provide a new and improved patient support system which is of durable and reliable constructions.

An even further object of the present invention is to provide a new and improved patient support system which is susceptible of a low cost of manufacture with regard to both materials and labor, and which accordingly is then susceptible of low prices of sale to the consuming public, thereby making such patient support system economically available to the buying public.

Lastly, another object of the present invention is to provide a patient support system for lifting and holding a supine patient.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a patient support system constructed in accordance with the principles of the present invention.

FIG. 2 is a cross sectional view taken along line -2 of FIG. 1.

The same reference numerals refer to the same parts throughout the various Figures.

DESCRIPTION OF THE PREFERRED EMBODIMENT

Figure 3:
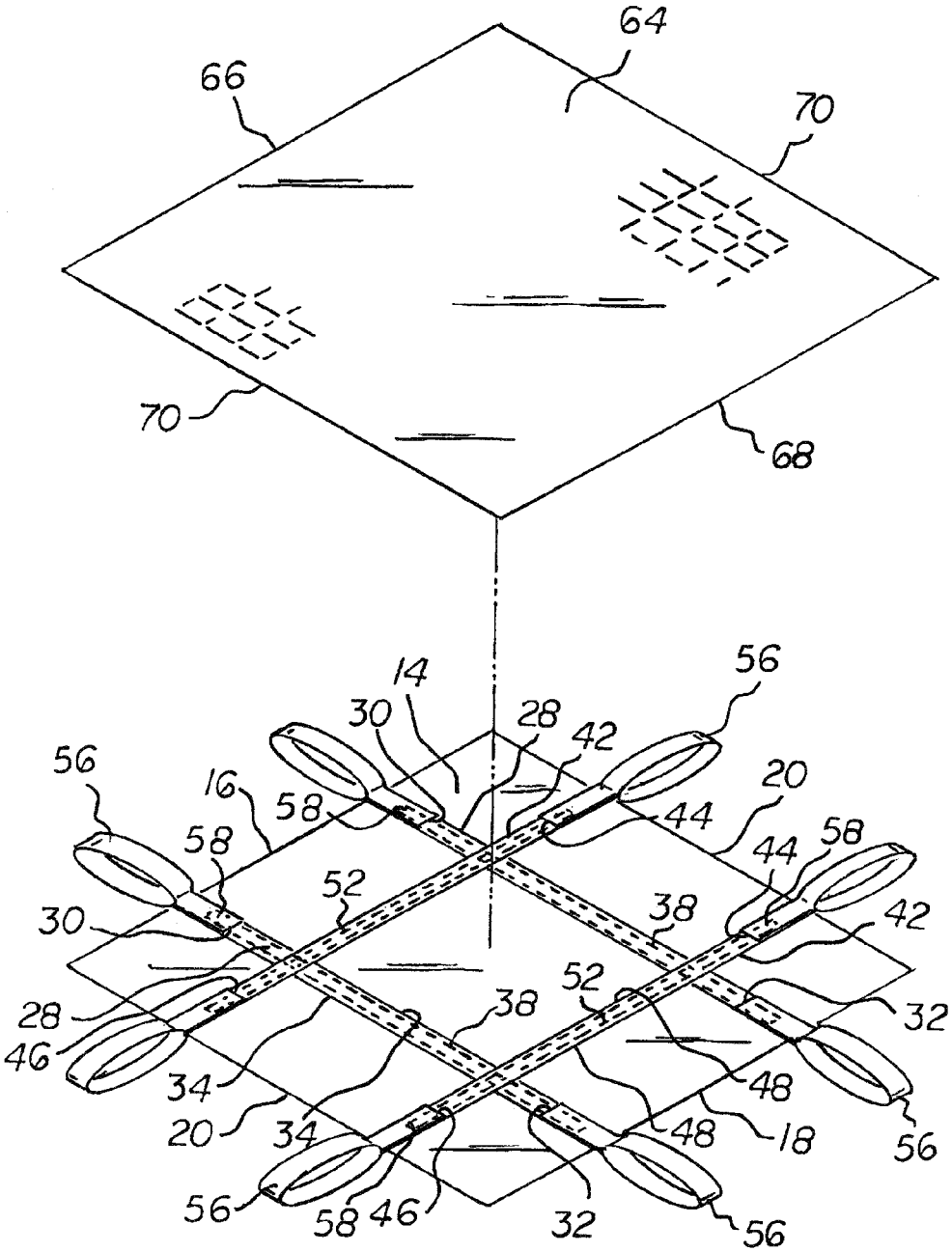
FIG. 3 is an exploded perspective illustration of the system of the prior Figures.

With reference now to the drawings, and in particular to FIG. 1 thereof, the preferred embodiment of the new and improved patient support system embodying the principles and concepts of the present invention and generally designated by the reference numeral 10 will be described.

The present invention, the patient support system 10 is comprised of a plurality of components. Such components in their broadest context include a first sheet, a pair of vertical straps, selecting stitching, a pair of horizontal straps, additional selective stitching, a loop, a second sheet, and peripheral stitching. Such components are individually configured and correlated with respect to each other so as to attain the desired objective.

From a specific standpoint, the preferred embodiment of the invention, the patient support system, is designated by reference numeral 10. First provided is a first sheet 14 in a square configuration with a horizontal top edge 16 and a parallel bottom edge 18 and with vertical parallel side edges 20 between the top and bottom edges. Each edge has a length of 37 inches. The first sheet is fabricated of a woven cotton fabric and may thus have a right side 22 and a wrong side 24.

Next provided are a pair of vertical straps 28. Each vertical strap is in a rectangular configuration with a horizontal top 30 and a parallel bottom 32 and with vertical parallel sides 34 between the top and bottom. Each top and bottom has a length of 2 inches. Each side has opposed ends with a length of 65 inches. The vertical straps are fabricated of an essentially inextensible strapping cord.

Selective stitching 38 couples each vertical strap to the wrong side of the first sheet with 14 inches at each end of each vertical strap extending beyond the first sheet. Each vertical strap is parallel with and spaced a distance of 9.5 inches from an adjacent side edge.

A pair of horizontal straps 42 in next provided. Each horizontal strap is in a rectangular configuration with a horizontal top 44 and a parallel bottom 46 and with vertical parallel sides 48 between the top and bottom edges. Each top and bottom has opposed ends with a length of 65 inches. Each side has a length of 2 inches. The horizontal straps is fabricated of an essentially inextensible strapping cord.

Additional selective stitching 52 couples each horizontal strap to the wrong side of the first sheet with 14 inches at each end of each horizontal strap extending beyond the first sheet. Such horizontal strap is parallel with and spaced a distance of 9.5 inches from an adjacent top and bottom edge.

A loop 56 is formed by each end of each strap being folded over with a 2 inch box stitch 58 coupling each end of each strap to the first sheet and to each strap at a location one inch from an adjacent edge of the first sheet to thereby create 8 handles. An additional 2 inch box stitch 60 at four intersections of the horizontal and vertical straps coupling the straps to the first sheet.

A second sheet 64 is provided next. The second sheet is in a square configuration with a horizontal top edge 66 and a parallel bottom edge 68 and with vertical parallel side edges 70 between the top and bottom edges. Each edge has a length of 37 inches. The second sheet is fabricated of a quilted fabric with a right side and a wrong side. The right side preferably has an ornamental design.

Lastly, peripheral stitching 74 couples the first sheet and the second sheet with the straps between the sheets. The peripheral stitching extends along the side edges and the top edges and the bottom edges of the first and second sheets. The edges are all folded inwardly prior to the peripheral stitching whereby the final product is a 36 inch square with the peripheral stitching through four layers of fabric. The stitching along each edge is discontinuous with a space 76 for the passage of the straps from between the first and second sheets. In this manner, the handles are adapted to be pulled by a health care provider to lift and hold the supine patient as for cleaning, feeding and like purposes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A patient support system (10) for lifting and holding a supine patient from a bed for cleaning, feeding, and like purposes, the lifting and holding being done in a safe, convenient, and economical manner, the system comprising, in combination:

a first sheet (14) in a square configuration with a horizontal top edge (16) and a parallel bottom edge (18) and with vertical parallel side edges (20) between the top and bottom edges, each edge has a length of 37 inches, plus or minus 10 percent, the first sheet is fabricated of a woven cotton fabric having a right side (22) and a wrong side (24);

a pair of vertical straps (28), each vertical strap being in a rectangular configuration with a horizontal top (30) and a parallel bottom (32) and with vertical parallel sides (34) between the top and bottom, each top and bottom has a length of 2 inches, plus or minus 10 percent, each side has opposed ends with a length of 65 inches, plus or minus 10 percent, the vertical straps being fabricated of an essentially inextensible strapping cord;

selective stitching (38) coupling each vertical strap to the wrong side of the first sheet with 14 inches at each end of each vertical strap extending beyond the first sheet, each vertical strap being parallel with and spaced a distance of 9.5 inches from an adjacent side edge;

a pair of horizontal straps (42), each horizontal strap being in a rectangular configuration with a horizontal top (44) and a parallel bottom (46) and with vertical parallel sides (48) between the top and bottom edges, each top and bottom having opposed ends with a length of 65 inches, plus or minus 10 percent, each side has a length of 2 inches, plus or minus 10 percent, the horizontal straps being fabricated of an essentially inextensible strapping cord;

additional selective stitching (52) coupling each horizontal strap to the wrong side of the first sheet with 14 inches at each end of each horizontal strap extending beyond the first sheet, each horizontal strap being parallel with and spaced a distance of 9.5 inches from an adjacent top and bottom edge;

a loop (56) formed by each end of each strap being folded over with a 2 inch, plus or minus 10 percent, box stitch (58) coupling each end of each strap to the first sheet and to each strap at a location one inch, plus or minus 10 percent, from an adjacent edge of the first sheet to thereby create 8 handles, an additional 2 inch, plus or minus 10 percent, box stitch (60) at four intersections of the horizontal and vertical straps coupling the straps to the first sheet;

a second sheet (64) being in a square configuration with a horizontal top edge (66) and a parallel bottom edge (68) and with vertical parallel side edges (70) between the top and bottom edges, each edge having a length of 37 inches, plus or minus 10 percent, the second sheet being fabricated of a quilted fabric with a right side and a wrong side, the right side having an ornamental design; and peripheral stitching (74) coupling the first sheet and the second sheet with the straps between the sheets, the peripheral stitching extending along the side edges and the top edges and the bottom edges of the first and second sheets, the edge all being folded inwardly prior to the peripheral stitching whereby the final product is a 36 inch, plus or minus 10 percent, square with the peripheral stitching through four layers of fabric, the stitching along each edge is discontinuous with a space (76) for the passage of the straps from between the first and second sheets whereby the handles are adapted to be pulled by a health care provider to lift and hold the supine patient as for cleaning, feeding, and like purposes.

* * * * *